US010435891B1

(12) United States Patent
Freemon

(10) Patent No.: US 10,435,891 B1
(45) Date of Patent: Oct. 8, 2019

(54) FLOORING SYSTEM

(71) Applicant: Thomas Freemon, Newbury Park, CA (US)

(72) Inventor: Thomas Freemon, Newbury Park, CA (US)

( * ) Notice: Subject to any disclaimer, the term of this patent is extended or adjusted under 35 U.S.C. 154(b) by 0 days.

(21) Appl. No.: 16/057,770

(22) Filed: Aug. 7, 2018

(51) Int. Cl.

| | |
|---|---|
| ***E04B 2/00*** | (2006.01) |
| ***E04F 15/02*** | (2006.01) |
| ***E04G 11/48*** | (2006.01) |
| ***E04F 15/06*** | (2006.01) |
| ***E04F 15/18*** | (2006.01) |

(52) U.S. Cl.
CPC ..... *E04F 15/0215* (2013.01); *E04F 15/06* (2013.01); *E04F 15/181* (2013.01); *E04G 11/48* (2013.01)

(58) Field of Classification Search
CPC ..... E04F 15/0215; E04F 15/06; E04F 15/181; E04G 11/48
USPC ..... 52/506.05
See application file for complete search history.

(56) References Cited

U.S. PATENT DOCUMENTS 2,412,778 A * 12/1946 Kosek ..... B64C 1/18 182/222
2,663,270 A * 12/1953 Friedly ..... E04D 3/3605 29/432
2,694,475 A * 11/1954 Crafton ..... E04B 5/10 52/220.4
2,992,711 A * 7/1961 Mitchell ..... E04C 2/3405 52/783.19
3,251,167 A * 5/1966 Curran ..... E04B 5/40 52/327
3,372,523 A * 3/1968 Hall, Jr. ..... E04B 1/4157 52/336
3,720,029 A * 3/1973 Curran ..... E04B 5/40 52/334
3,759,006 A * 9/1973 Tamboise ..... E04B 5/10 52/406.1
4,285,173 A * 8/1981 Grearson ..... E04B 5/40 52/250
4,333,280 A * 6/1982 Morton ..... E04B 1/24 52/167.1
4,894,967 A * 1/1990 Morton ..... E04B 7/00 228/182
5,605,423 A * 2/1997 Janusz ..... E04B 5/29 411/387.6

(Continued)

*Primary Examiner* — Basil S Katcheves
(74) *Attorney, Agent, or Firm* — Gulf Coast Intellectual Property Group

(57) ABSTRACT

A flooring system configured to be installed in a multi-story building wherein the flooring system is operably coupled with a portion of the superstructure of the building. The flooring system includes a first layer of corrugated metal panel that is position in a horizontal orientation and is operable to superposed at least a portion of the superstructure of the building. A plurality of mounting studs are secured to a portion of the superstructure of the building and extend upward through the first layer. A second layer of corrugated metal panel is superposed the first layer and secured thereto. The second layer has an adhesive layer applied to the upper surface thereof. A third layer is superposed the upper surface of the second layer. The third layer is manufactured from a different material than the first and second layer. A structural foam layer is injected intermediate the third and second layer.

2 Claims, 5 Drawing Sheets

(56) References Cited

U.S. PATENT DOCUMENTS

| | | | | |
|---|---|---|---|---|
| 5,765,329 | A * | 6/1998 | Huang | E04D 3/30 165/49 |
| 6,240,682 | B1 * | 6/2001 | James | E04B 7/024 52/712 |
| 6,415,581 | B1 * | 7/2002 | Shipman | E04B 5/40 428/593 |
| 7,861,480 | B2 * | 1/2011 | Wendelburg | E04C 3/07 52/471 |
| 7,987,647 | B2 * | 8/2011 | Rymell | E04D 3/3608 52/408 |
| 8,479,460 | B1 * | 7/2013 | Meyer | E04B 5/10 52/177 |
| 8,661,754 | B2 * | 3/2014 | Hsu | E04B 5/40 52/289 |
| 8,931,232 | B2 * | 1/2015 | Kelly | F16B 43/00 411/368 |
| 9,027,286 | B2 * | 5/2015 | Lane | E04D 3/3608 52/506.05 |
| 9,151,048 | B2 * | 10/2015 | Abugattas | E04B 5/48 |

* cited by examiner

FLOORING SYSTEM

FIELD OF THE INVENTION

The present invention relates generally to structural floors, more specifically but not by way of limitation, a flooring system for a structure such as but not limited to a commercial building wherein the flooring system is comprised of a combination of corrugated metal panels and additional materials.

BACKGROUND

There are numerous types of flooring materials and construction techniques for erecting floors in multi-story buildings. Whether for a residential structure or a commercial building flooring systems typically include at least one subfloor layer and an additional layer of flooring material superposed thereon. For commercial structures it is quite common to utilize concrete to construct the floor. Concrete floor construction techniques include but are not limited to the utilization of pre-formed concrete panels or pouring the concrete into forms that have been laid.

One drawback with existing floor construction techniques such as but not limited to concrete is the weight of the floor. During construction the logistics and equipment required to ship and install concrete panels can be quite costly. Special equipment and additional labor is required to ship and install concrete floors, which add to the overall cost of the project. Structures that employ concrete floors further require additional engineering so as to support the weight of the floor. Additional structural elements such as but not limited to weight bearing pilasters are required to support the concrete floors. These structural elements lead to an overall structure type that may be less desirable in areas such as but not limited to areas that have limited bearing soil.

Accordingly, there is a need for a flooring system and method of construction that comprises lightweight materials enabling improved logistics of the materials, reducing the overall weight of the floor and providing an improved installation technique when compared to traditional floor construction.

SUMMARY OF THE INVENTION

It is the object of the present invention to provide a flooring system for a structure that utilizes layers of corrugated metal panel assembled in the technique of the present invention wherein the flooring system is operably coupled with the superstructure of the building.

Another object of the present invention is to provide a flooring system that provides a lightweight floor for a multi-story building wherein the flooring system construction technique utilizes a base layer of scaffolding and a temporary support surface.

A further object of the present invention is to provide a flooring system for a building wherein the flooring system employs a first layer of corrugated metal panel wherein the first layer of corrugated metal panel is superposed the temporary support surface.

Still another object of the present invention is to provide a lightweight flooring system for a commercial building wherein the first layer of corrugated metal panel further includes a configuration of perforations.

An additional object of the present invention is to provide a flooring system for a building wherein the flooring system further includes a plurality of shear studs that are secured to the upper surface of the first layer of corrugated metal panel.

Yet a further object of the present invention is to provide a lightweight flooring system for a commercial building wherein the plurality of shear studs further have surroundably mounted thereto pad washers.

Another object of the present invention is to provide a flooring system for a structure wherein the flooring system includes a second layer of corrugated metal panel wherein the second layer of corrugated metal panel is superposed the first layer of corrugated metal panel.

An alternate object of the present invention is to provide lightweight flooring system and construction technique utilizing at least two layers of corrugated metal panel wherein the layers of corrugated metal panel are resistance welded together subsequent installation thereof.

Still a further object of the present invention is to provide a flooring system for a commercial building that further includes an upper floor layer wherein the upper floor layer is superposed the second layer of corrugated metal panel.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 2:
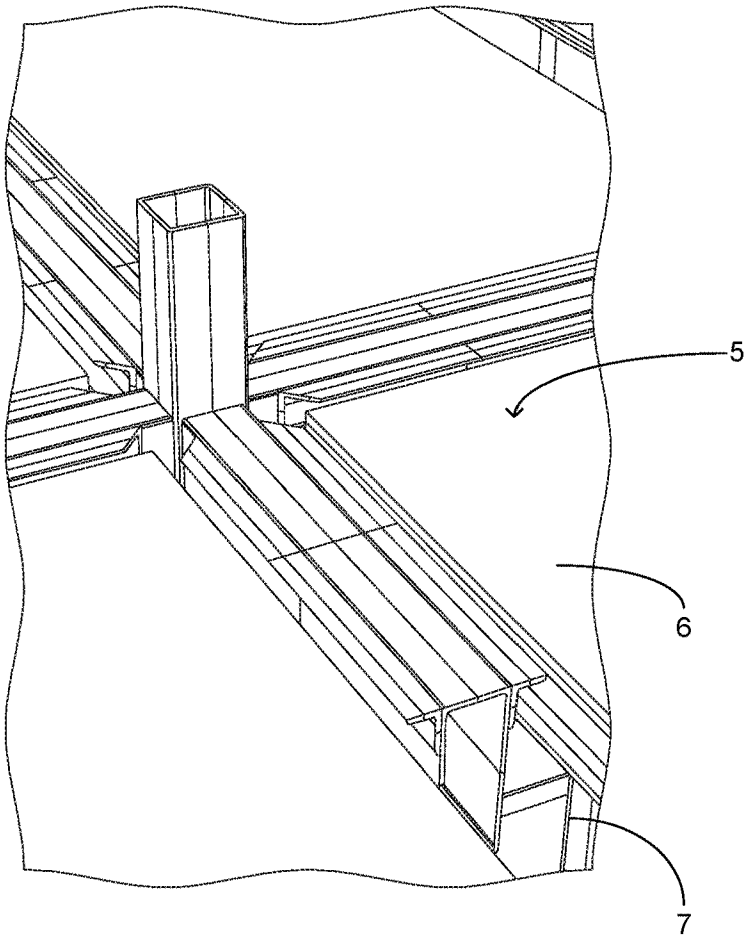
FIG. 2 is a exemplary portion of a steel superstructure with the temporary support surface of the technique of the present invention installed.

Referring now to the drawings submitted herewith, wherein various elements depicted therein are not necessarily drawn to scale and wherein through the views and figures like elements are referenced with identical reference numerals, there is illustrated a flooring system 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Figure 1:
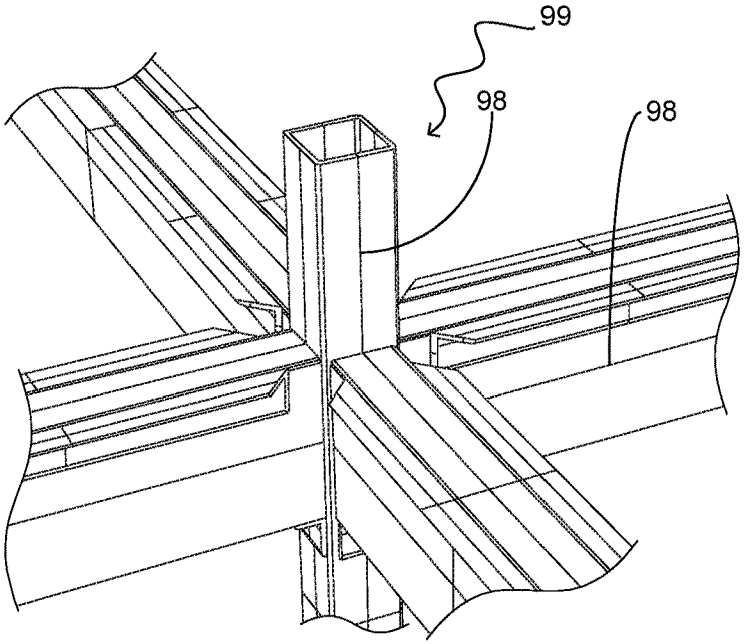
FIG. 1 is an exemplary portion of a steel superstructure of a building.

Referring in particular FIG. 1 herein, the flooring system 100 is constructed to be operably coupled to a internal support structure for a building. FIG. 1 herein illustrates a portion of an exemplary steel superstructure 99 of a commercial building being comprised of steel beams 98. As is known in the art, exemplary steel superstructures 99 can consist of elements such as but not limited to steel tubing or beams. Within the scope of the present invention, the type of internal support structure could vary and the exemplary steel superstructure 99 disclosed herein is for exemplary purposes only and does not function to provide limitation thereto. The initial step in the process of constructing the flooring system 100 is to erect a temporary support structure 5. The temporary support structure 5 includes a horizontal support surface 6 that is manufactured from a durable rigid material such as but not limited to wood. The horizontal support surface 6 is supported by braces 7 that are arranged in a suitable configuration so as to maintain the horizontal support surface 6 in a level orientation. It is contemplated within the scope of the present invention that the temporary support structure 5 could be conventional scaffolding or similar structure. While the horizontal support surface 6 is illustrated and discussed herein as being level in orientation, it is contemplated within the scope of the present invention that the horizontal support surface 6 could be formed with convexity so as to have a slightly elevated center.

Figure 3:
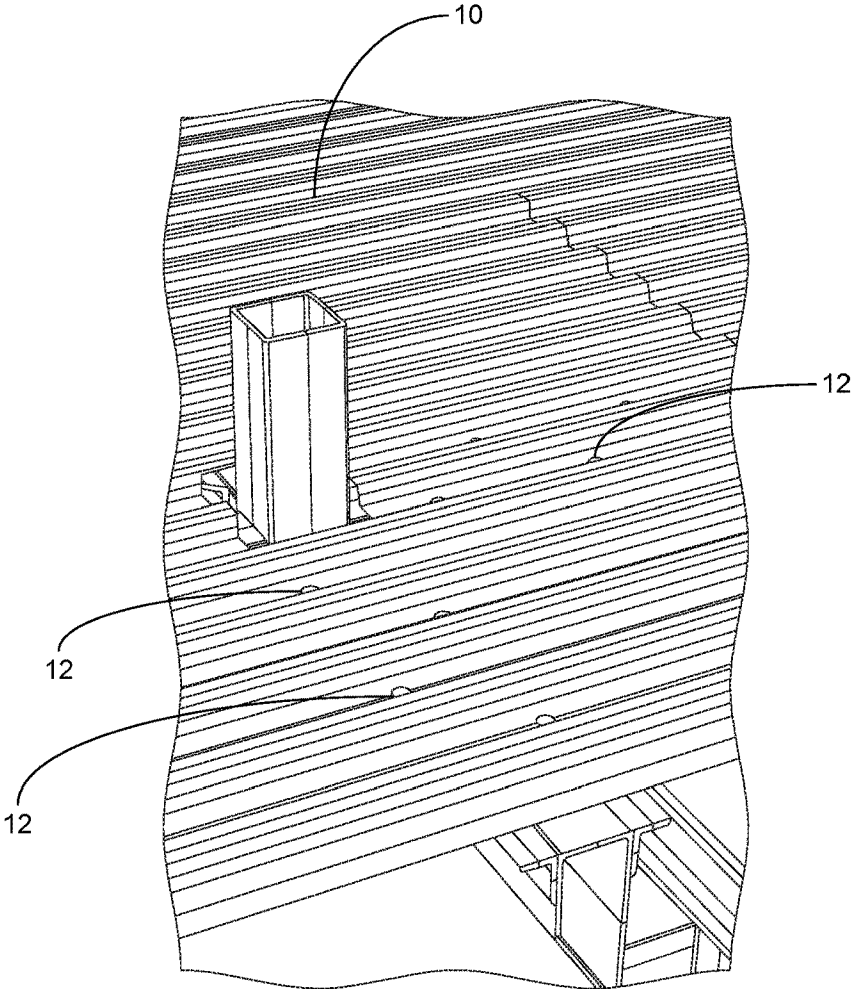
FIG. 3 is a perspective view of the first layer of the flooring system of the present invention.

Referring in particular to FIG. 3 herein, the step immediately subsequent erection of the temporary support structure 5 is illustrated therein. The flooring system 100 includes a first layer 10. The first layer 10 is superposed the horizontal support surface 6 and the beams 98. The first layer 10 is manufactured from a suitable durable material such as but not limited to corrugated metal panel. While in the preferred embodiment of the flooring system 100 the first layer 10 is manufactured from corrugated metal panel, it is contemplated within the scope of the present invention that the first layer 10 could be manufactured from alternate durable rigid materials. The first layer 10 includes a plurality of perforations 12. The perforations 12 are arranged in a linear manner so as to axially align with the beams 98. The perforations 12 are operable to facilitate the installation of mounting studs 20 as is further discussed herein. While the perforations 12 are illustrated herein in a linear pattern so as to be in axial alignment with the beams 98, it is contemplated within the scope of the present invention that the perforations 12 could be formed in alternate configurations. Additionally, it is further contemplated within the scope of the present invention that the first layer 10 could be deployed in the flooring system 100 without perforations 12.

Figure 4:
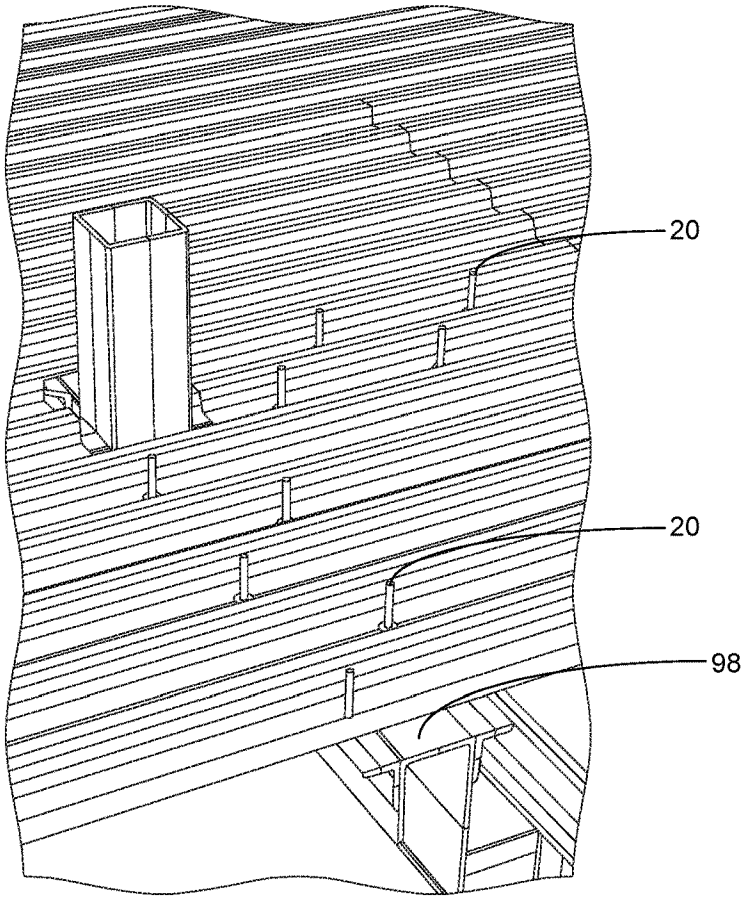
FIG. 4 is a perspective view of the first layer having shear studs operably coupled thereto.

Referring now to FIG. 4, the next step in creating the flooring system 100 comprises of installing the mounting studs 20. The mounting studs 20 are secured to the beams 98 utilizing suitable durable techniques such as but not limited to welding. The mounting studs 20 are secured to the beams 98 and extend upward through the perforations 12. The mounting studs 20 in a preferred embodiment are threaded metal rods and are secured to the beams 98 utilizing a welding technique that employs a ceramic ferrule during the welding process so as to inhibit the formation of iron oxide.

Figure 5:
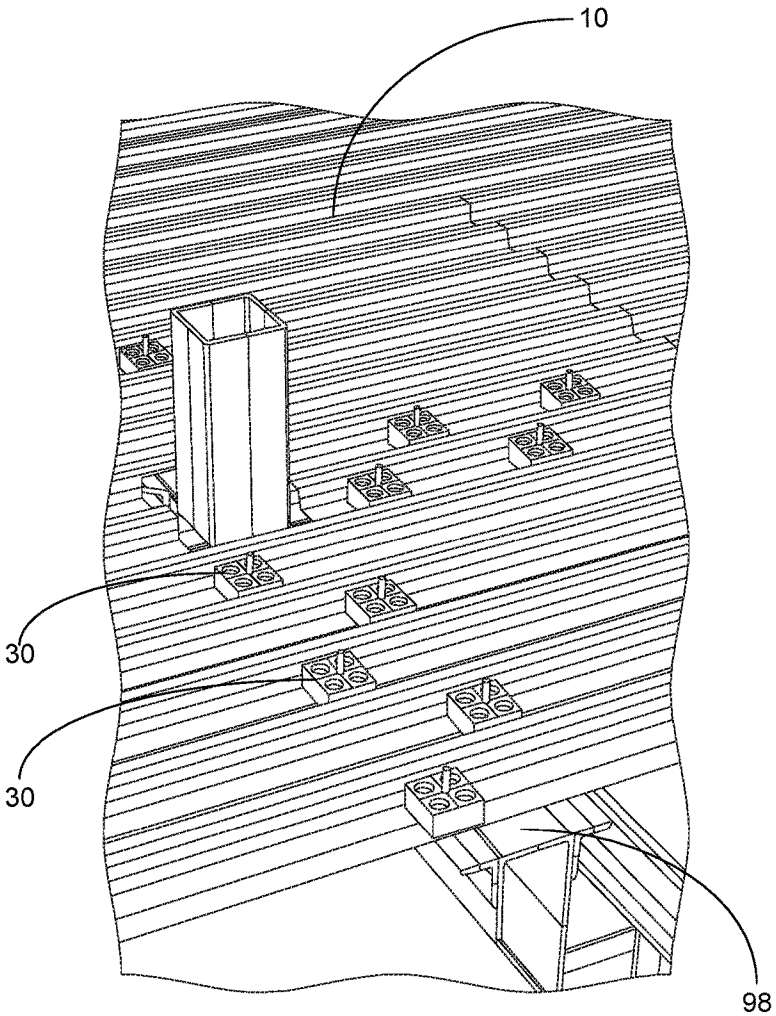
FIG. 5 is a perspective view of the first layer of the flooring system with pad washers installed.

As illustrated in FIG. 5, ensuing the placement of the mounting studs 20, the following step is to provide and install pad washers 30. The pad washers 30 are manufactured from a suitable durable rigid material and are surroundably mounted to the mounting studs 20. The combination of the mounting studs 20 and the pad washers 30 function to provide a direct connection intermediate the beams 98 and the second layer 40. While the pad washers 30 have been illustrated herein as being square in shape, it is contemplated within the scope of the present invention that the pad washers 30 could be formed in alternate shapes and sizes.

Figure 6:
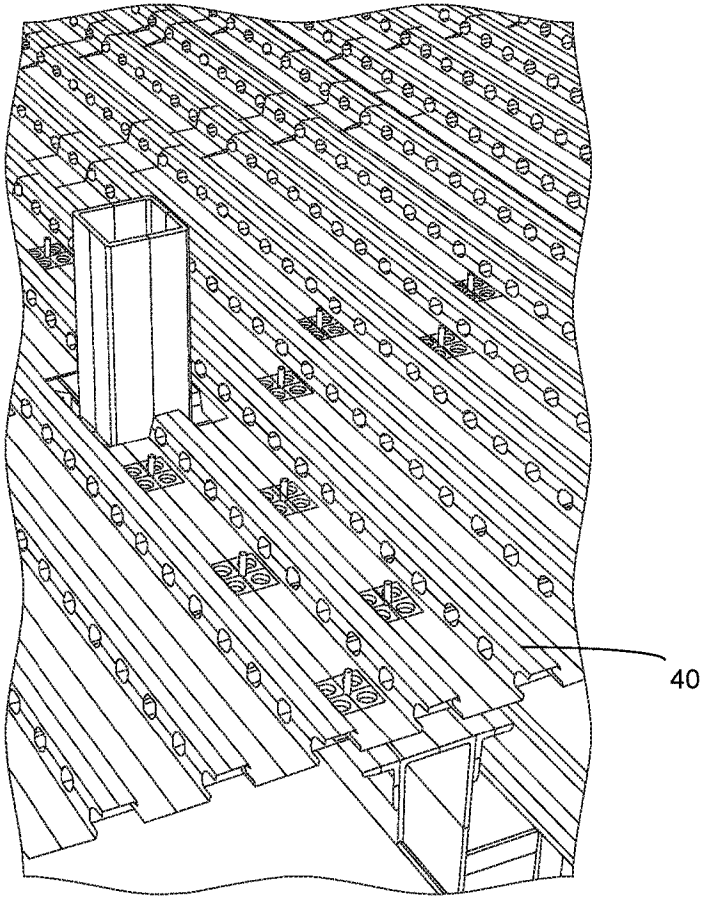
FIG. 6 is a perspective view of the second layer of corrugated metal panel of the present invention.

FIG. 6 herein provides illustration of the next step for creating the flooring system 100. A second layer 40 is superposed the first layer 10. The second layer 40 is manufactured from a suitable durable rigid material such as but not limited to a corrugated metal panel. The second layer 40 is superposed the first layer 10 so as to substantially cover the first layer 10. Ensuing the placement of the second layer 40, a plurality of bearing washers 50 are superposed the second layer 50 so as to surroundably mount the mounting studs 20. The bearing washers 20 are planar in manner and manufactured from a durable rigid material. The bearing washers 50 are secured in place utilizing mechanical techniques such as but not limited to a nut operably coupled with the mounting stud 20. While not illustrated herein, it is additionally contemplated within the scope of the present invention that the second layer 40 could be secured to the first layer 10 utilizing the technique of resistance welding. Employing the technique of resistance welding could include a variety of alternate weld patterns suitable to provide the objective of securing the second layer 40 to the first layer 10. While not illustrated herein, subsequent the installation of the second layer 40, utility lines such as but not limited to electrical or plumbing could be installed.

Figure 8:
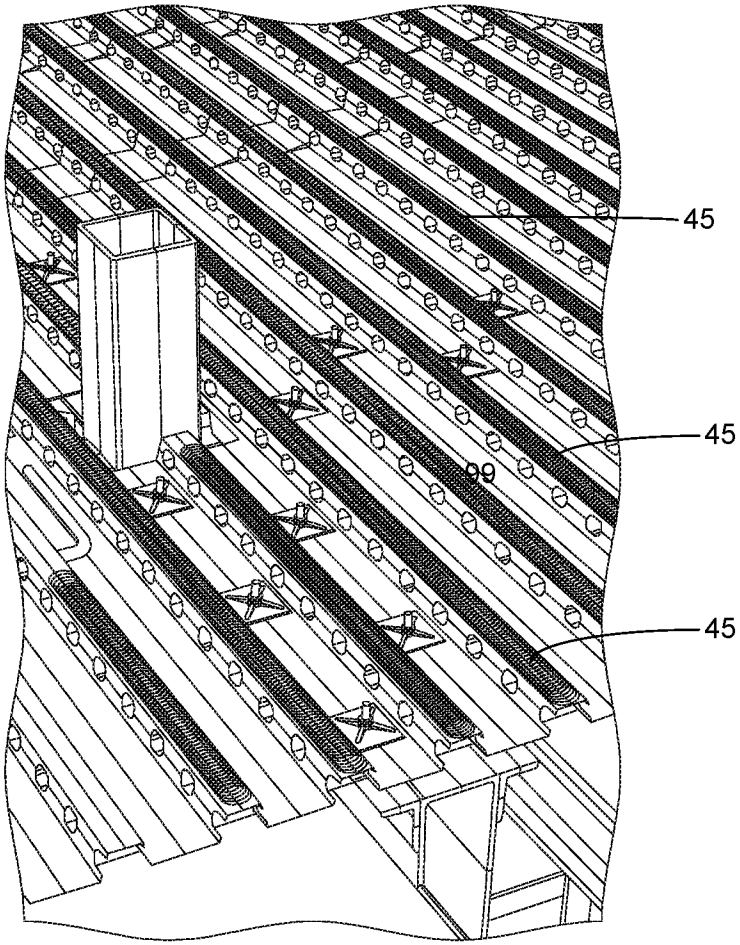
FIG. 8 is a perspective view of the second layer of the present invention with the adhesive layer in position.
Figure 7:
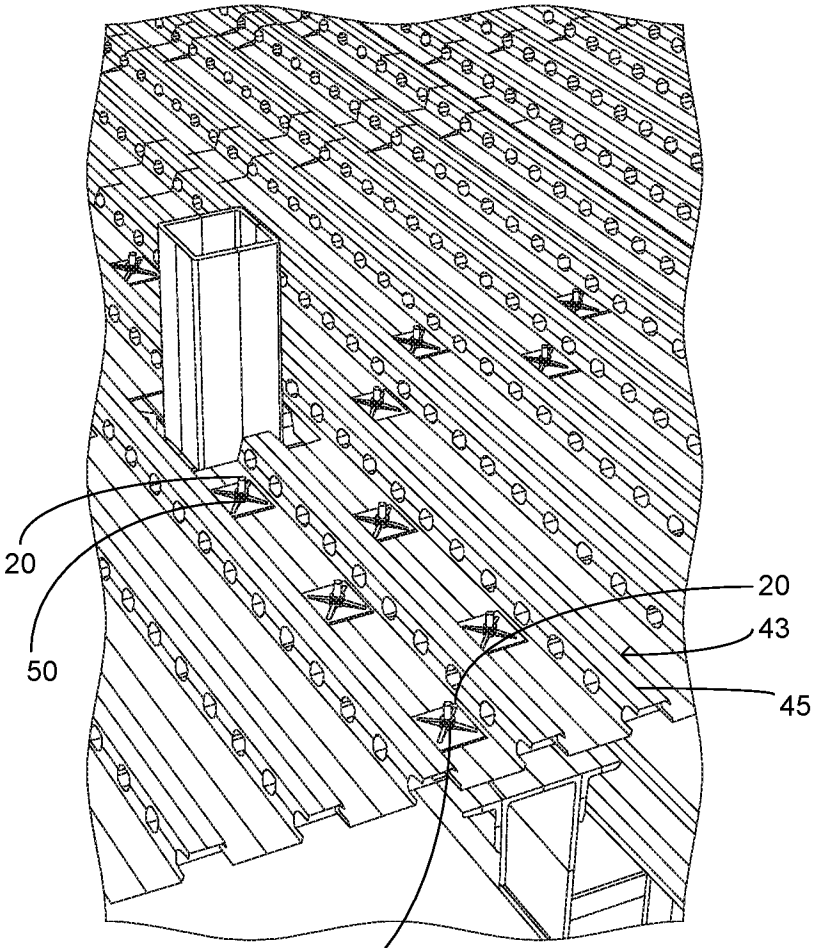
FIG. 7 is a perspective view of the second layer of the present invention with the bearing washers installed.
Figure 10:
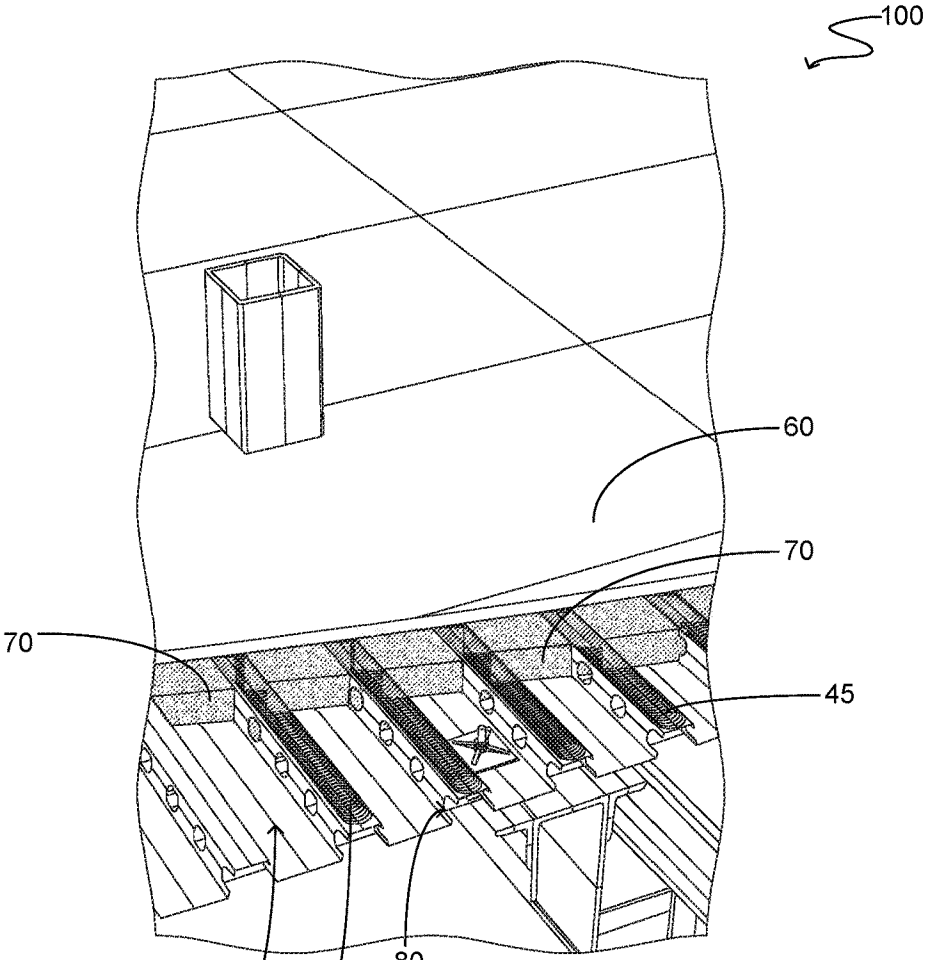
FIG. 10 is a perspective view of the present invention illustrating the upper floor layer with the insulating layer installed.

Illustrated in FIG. 8 herein, is the step following the securing of the second layer 40. Following the installation of the second layer 40, an adhesive layer 45 is applied to the upper surface 43 of the second layer 40. The adhesive layer 45 is applied to the second layer 40 utilizing suitable techniques. It is contemplated within the scope of the present invention that the adhesive layer 45 could be comprised of numerous types of adhesive suitable for bonding construction materials. The adhesive layer 45 will provide the technique to secure the third layer 60 of the flooring system 100. It should be understood by those skilled in the art that the adhesive layer 45 could be superposed the second layer 40 in alternate quantities and distribution in order to achieve the desired objective of securing a third layer 60 to the second layer 40.

Figure 9:
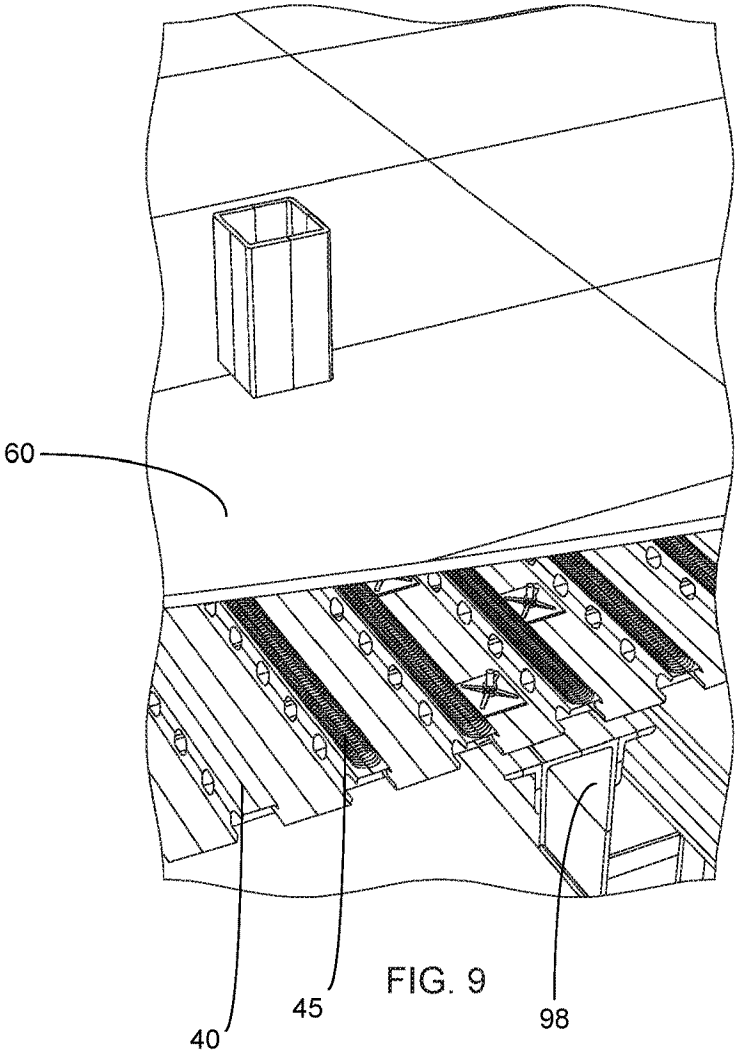
FIG. 9 is a perspective view of the present invention illustrating the upper floor layer.

Illustrated herein in FIG. 9, the step of installing the third layer 60 is illustrated therein. The third layer 60 is superposed the second layer 40 and secured thereto by the adhesive layer 45 which is intermediate the second layer 40 and the third layer 60. The third layer 60 is manufactured from a suitable durable material such as but not limited to plywood. It is contemplated within the scope of the present invention that the third layer 60 could be comprised alternate materials and further be applied in various patterns. Ensuing the installation of the third layer 60, the foam layer 70 is introduced into the voids 71 intermediate the second layer 40 and the third layer 60. The foam layer 70 is manufactured from a structural foam and is installed into the flooring system 100 utilizing suitable techniques such as but not limited to injection. Injection of the foam layer 70 provides reinforcement of the ribs 80 of the second layer 40. Alternatively, the foam layer further provides benefits to any utility lines installed into the flooring system 100. Subsequent the injection of the foam layer 70, the flooring system 100 is completely installed and as such the temporary support structure 5 can be removed.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A method of installing a flooring system in a building comprising the steps of:

installing a temporary support structure, said temporary support structure being placed intermediate a superstructure of a building, said temporary support structure having a horizontal support surface;

installing a first layer, said first layer having a lower surface and an upper surface, said first layer being manufactured from a rigid material, said first layer being superposed on said temporary support structure, said first layer further being superposed on at least a portion of the superstructure of the building, said first layer further including a plurality of perforations, said plurality of perforations being in axial alignment with a portion of the superstructure of the building, said first layer being manufactured from corrugated metal panel;

securing a plurality of mounting studs, said plurality of mounting studs being secured to a portion of the superstructure to which the first layer is superposed, said plurality of mountings studs extending upwards from said first layer through said plurality of perforations;

installing a plurality of pad washers, said plurality of pad washers being superposed on said upper surface of said first layer, said plurality of pad washers being surroundably mounted to said plurality of mounting studs;

installing a second layer, said second layer being superposed on said upper surface of said first layer, said second layer being manufactured from corrugated metal panel, said second layer having an upper surface and a lower surface;

securing a plurality of bearing washers, said plurality of bearing washers being mechanically secured to the plurality of mounting studs and superposed on said upper surface of said second layer;

applying an adhesive layer, said adhesive layer being applied to at least a portion of said upper surface of said second layer;

installing a third layer, said third layer being superposed on said upper surface of said second layer, said third layer being manufactured from a different material than said first layer and said second layer;

injecting a structural foam layer, said structural foam layer being injected intermediate said second layer and said third layer.

2. The floor system as recited in claim 1, and further including the step of welding the second layer to the first layer, wherein the second layer is welded to the first layer utilizing resistance welding.

* * * * *